US005555587A

United States Patent [19]

Guha

[11] Patent Number: 5,555,587

[45] Date of Patent: Sep. 17, 1996

[54] FLOOR MOPPING MACHINE

[75] Inventor: Dwipendra N. Guha, Calcutta, Ind.

[73] Assignee: The Scott Fetzer Company, Westlake, Ohio

[21] Appl. No.: 504,432

[22] Filed: Jul. 20, 1995

[51] Int. Cl.[6] ..... A47L 11/292

[52] U.S. Cl. ..... 15/98

[58] Field of Search ..... 15/97.1, 98, 49.1, 15/50.1, 119.1, 103.5, 320; 401/13

[56] References Cited

U.S. PATENT DOCUMENTS

| | | | |
|---|---|---|---|
| 1,393,101 | 10/1921 | Espeland | 15/98 |
| 1,675,054 | 6/1928 | Santilli | 15/98 |
| 3,079,620 | 5/1963 | Hunter | 15/98 |
| 3,477,082 | 11/1969 | Odermann et al. | 15/98 |
| 3,822,433 | 7/1974 | Krekler | 15/98 |
| 3,950,812 | 4/1976 | Mohr | 15/98 |
| 4,542,549 | 9/1985 | McLaughlin | 15/98 |
| 4,577,364 | 3/1986 | Demetriades | 15/98 |
| 4,926,515 | 5/1990 | Lynn et al. | 15/98 |

FOREIGN PATENT DOCUMENTS

| | | | |
|---|---|---|---|
| 696159 | 10/1965 | Italy | 15/98 |
| 224905 | 10/1991 | Japan | 15/98 |

*Primary Examiner*—David Scherbel
*Assistant Examiner*—Tony G. Soohoo
*Attorney, Agent, or Firm*—Jones, Day, Reavis & Pogue

[57] ABSTRACT

A floor mopping machine for automatic mopping of the floor is disclosed comprising a movable housing and a rotatable mopping member including a plurality of spongy mop pieces capable of soaking liquid and releasing the same when pressed. The spongy mop pieces are provided in a manner such that during a rotation of the mopping member, the mop pieces are pressed on the floor and/or wall-wall and wall-floor corners. The machine further includes a rotating member for rotating the mopping means; a receptacle for storing and dispensing aqueous cleaning medium to the spongy mop pieces; a pressing member for pressing the spongy mop members to release the liquid held by the said members, and a collector for collecting the liquid released by the spongy mop pieces.

7 Claims, 4 Drawing Sheets

FLOOR MOPPING MACHINE

FIELD OF THE INVENTION

The present invention relates to a floor mopping machine for floor cleaning and automatic removal of dirty water from the mopped floor.

BACKGROUND OF THE INVENTION

The traditional method of floor cleaning is to use wet mops to remove dirt and other dirty smears on the floor. All mopping operations involve dipping the mop in a bucket of water, rubbing the wet mop manually on the floor to clean it, dipping the same mop back in the bucket of water to remove dirty water by dilution. In some previous mops a mechanical spring loaded attachment is provided to squeeze out the dirty water manually. The disadvantage of such mops are that they are tiresome to operate being completely manual and cleaning of floor is not satisfactory since after first few strokes the water in the bucket gets dirty and the same dirty water is used again to mop remaining part of the floor. A further disadvantage of the manual mopping is that the skirtings and the corner are not properly cleaned or even cleaned at all. Floor cleaning with vacuum cleaners is also known but the vacuum cleaners are not as effective on floor as they are on carpeted floor where the dirt is sucked. Furthermore, vacuum cleaners are not capable of cleaning dirty smears.

SUMMARY OF THE INVENTION

In view of the above noted drawbacks and disadvantages with previous systems, therefore an object of the present invention is to provide a floor mopping machine that will make mopping operation more efficient and easy.

It is a further object of the present invention to provide a floor mopping machine in which fresh water is supplied and dirty water is removed automatically and in which very low quantity of water is required for good cleaning.

It is another object of the present invention to provide a floor mopping machine which is portable, easy to operate, requires little maintenance, low cost and overcomes the drawbacks of conventional and traditional floor mopping.

It is yet another object of the present invention to provide a floor mopping machine that would clean the skirting and wall-wall and wall-floor junctions efficiently.

The above and other objects are satisfied in the present invention in which there is provided a floor mopping machine for automatic mopping of the floor comprising a movable housing enclosing a rotatable mopping means including a plurality of spongy mop pieces capable of soaking liquid and releasing the same when pressed. The spongy mop pieces are provided in a manner such that during rotation of the mopping means the said mops are pressed on the floor and/or wall-wall and wall-floor corners.

There is also provided a means for rotating the mopping means and means for storing and dispensing aqueous cleaning medium/liquid to said spongy mop members. A means for pressing the spongy mop members is provided for release of the liquid held by the said members along with a means for collecting the liquid released by this spongy mop members.

The above and other objects of the invention will become apparent from consideration of the following detailed description of the invention as is particularly illustrated in the accompanying drawings.

BRIEF DESCRIPTION OF THE DRAWINGS

The invention will now be illustrated with the help of the accompanying drawings, in which.

DETAILED DESCRIPTION OF THE INVENTION

According to a first embodiment of the invention, a mopping means is disclosed which comprises a plurality of arms rotatable about a vertical axis, said mop members replaceably held to the arms at the ends away from the axis of rotation. The arms are rotatable between mopping and pressing positions in a manner such that in mopping position the mop members are pressed on the surface to be cleaned and moves upward during its movement towards the pressing position where it is pressed and the dirty fluid released. The movement of the arms is controlled by a guiding means provided in said housing for guiding the arms between mopping and pressing positions. The guiding means comprises cam tracks on which the arms move with the help of rollers provided with the arms. The tracks being configured such that the ends of the arms carrying the mop members are pressed against the floor at the mopping position and are lifted to a higher plane to the pressing position for release of the liquid collected at the mopping position.

Figure 1A:
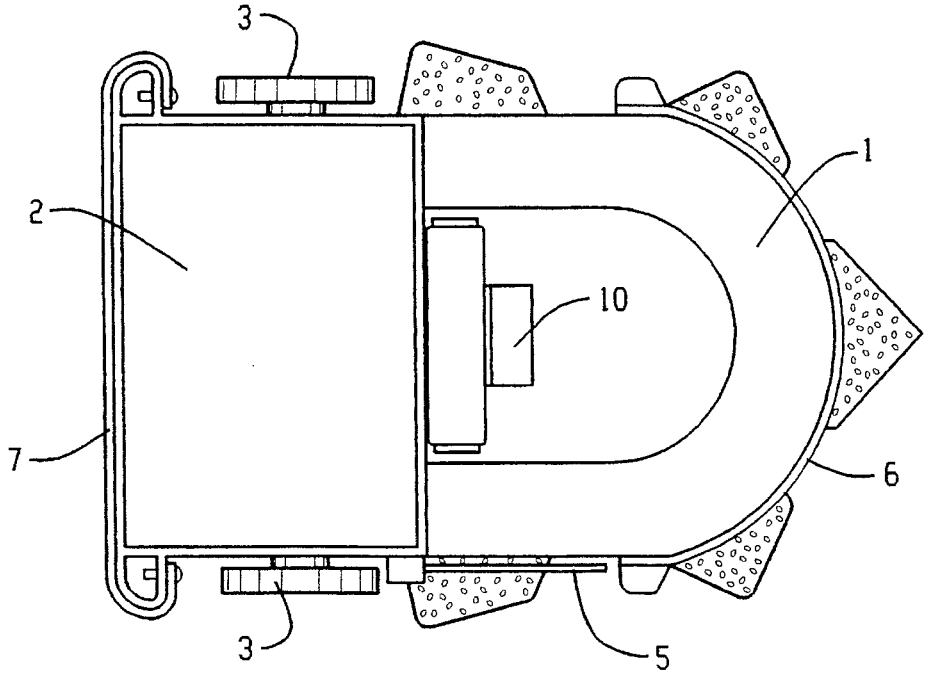
FIG. 1*a* is the top view of a first embodiment according to present invention.
Figure 1B:
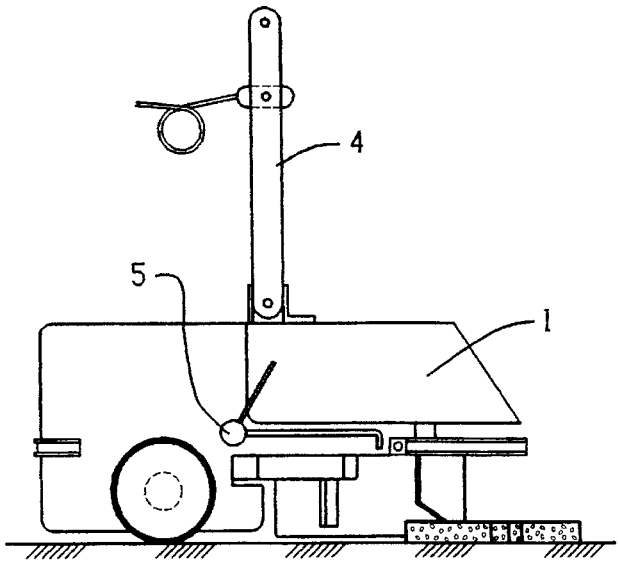
FIG. 1*b* is the side view of the first embodiment.
Figure 1C:
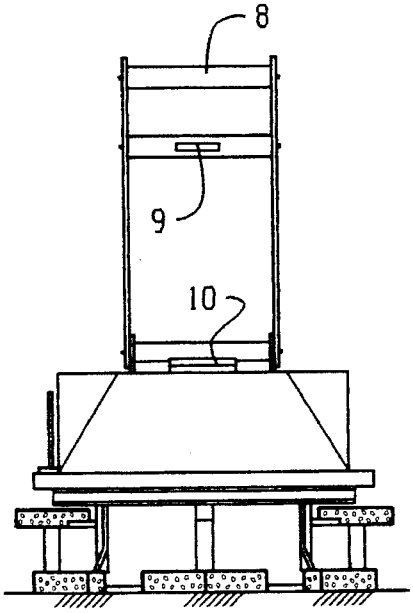
FIG. 1*c* is the front view of the first embodiment.

FIGS. 1*a*, 1*b* and 1*c* show an outer shell housing 1 with a fresh water trough 2 as one body. On this shell housing is mounted two rear wheels 3 and a handle assembly 4. Attached to the fresh water trough is a spout 5 which can be actuated to dispense fresh water during mopping. Shell housing 1 is provided with bumper straps 6, 7 in front and back. Close to the handle grip 8, a power switch 9 is located for easy switching operation. A spring plate 10 mounted on the shell housing helps to hold handle upright-during storage.

Figure 1D:
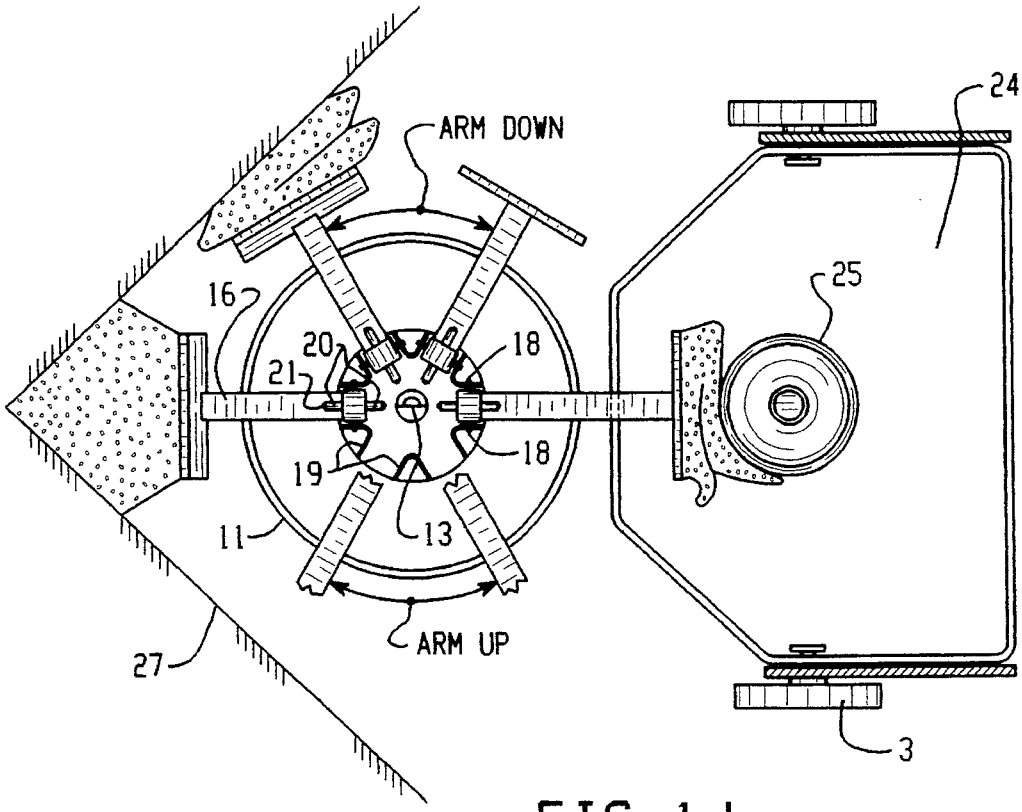
FIG. 1*d* is the top view of the first embodiment in an open position.
Figure 1E:
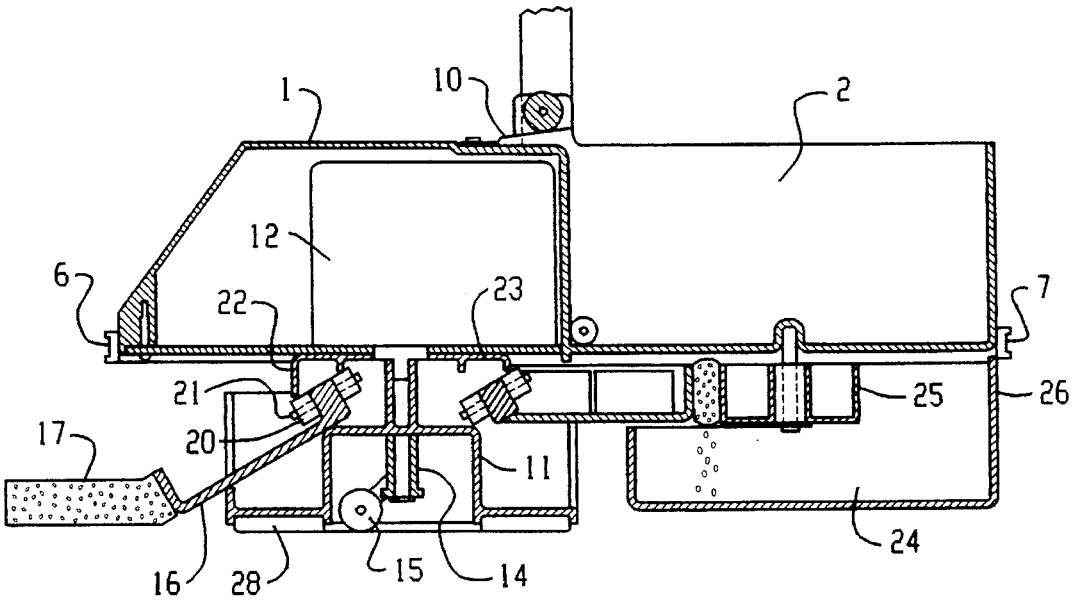
FIG. 1*e* is the cross sectional side-view of the same embodiment.

FIGS. 1*d* and 1*e* show the detailed construction of the mechanisms used in the first embodiment. A rotating drum 11 is fixed directly on to a motor 12. Motor spindle 13 is "D" shaped and so is the hole in the drum boss, thus allowing the motor 12 to turn the drum 11. The drum 11 is held vertically in position by a shoulder screw 14 which also accommodates the front swivelling wheel assembly 15. On the drum 11 are mounted several pivoting arms 16. These arms are restricted to move only up or down with respect to the drum and are guided laterally by slots and ribs 19 in the drum thus forcing them to rotate with the drum. To the outer end of each of the arms 16, foam pieces 17 are removably held for easy replacement when worn thin. The inside end of each of the arms 16 have pivot pins 18 on either side and these pivot pins 18 are located in slots in ribs 19 of the drum. Perpendicular to the pivot axis and located centrally on the arms are two rollers 20 on either side of the pivot axis. These rollers 20 rotate on shafts 21 fixed to the arm. As the drum 11 rotates these two rollers 20 are alternately acted upon by two fixed cam tracks. The outer cam-track 22 acts on the outer roller forcing the arm 16 down until the foam piece 17 is pressed on the floor thus ensuring mopping pressure only when the foam piece 17 is at the front part of the machine.

As the arm 16 rotates towards the back of the machine, the outer cam-track 22 loses contact with the outer roller and the inner cam-track 23 comes in contact with the inner roller in the arm 16 to lift the arm 16 with the foam piece soaked in dirty water high enough to clear the trough 24 for dirty water and comes in contact with the roller 25 against which the foam piece 17 is squeezed and dirty water is deposited inside the trough. The dirty water trough can be removed by disengaging a catch 26 and sliding it out. It is to be noted that the up and down movement of the arm 16 can also be achieved by other means e.g. one cam-track and a spring pulling the arm 16 against it. In FIG. 1(*d*) it is shown that by properly shaping the foam pieces 17 wall-wall and wall-floor corners can be cleaned easily. FIG. 1(*d*) also shows the shape and size of the front part of the shell housing having an outline 27 is so designed that when the housing is held against a wall or walls no jamming will occur due to rotating arms hitting the wall. In order to clean the floor thoroughly and remove stubborn dirt from the floor, a scouring pad 28 can be attached to the bottom of the rotating drum 11.

According to a second embodiment of the invention, a rotatable mopping means is disclosed which comprises a horizontally rotatable drum on the outer surface of which spongy mop members are provided at predetermined positions. A pressing means is shown constituted by a horizontal roller having an axis of rotation substantially parallel to the drum and being spaced from the drum such that the mop members are pressed against the roller when the drum rotates. During the pressing of the mop members against the rollers, the dirty liquid collected by the mop members is released. The liquid collecting member is positioned below the said roller so as to collect the liquid released by said mop members.

Figure 2B:
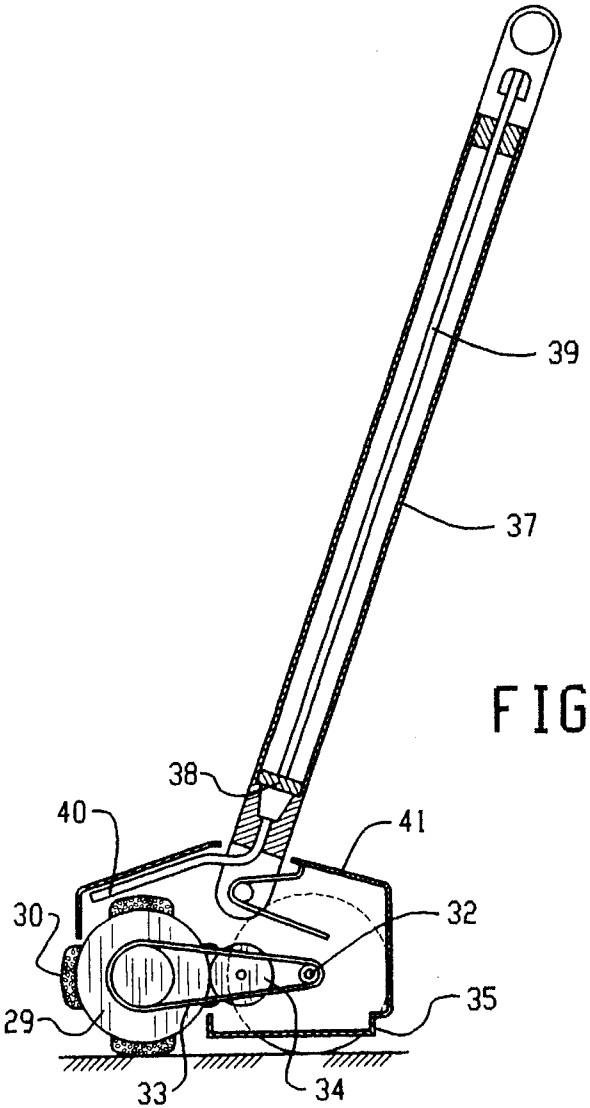
FIGS. 2*a* and 2*b* are views showing a second embodiment of the present invention.
Figure 2A:
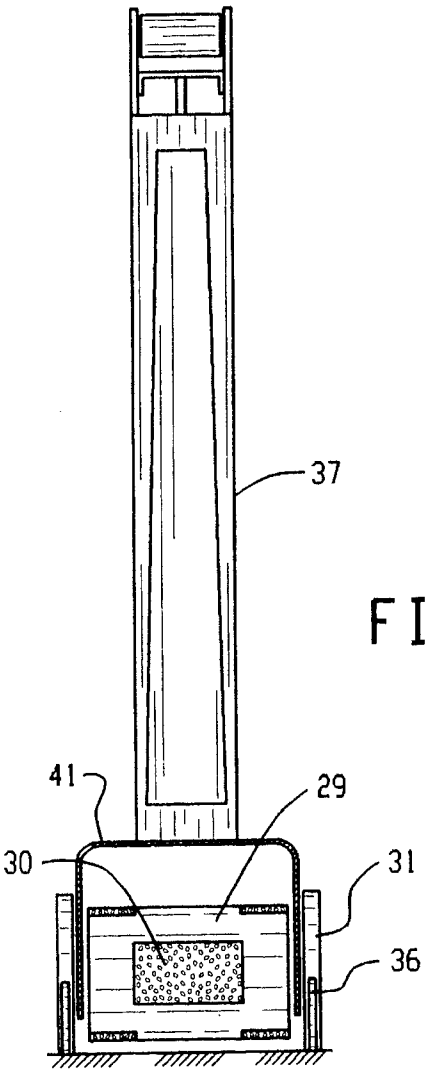

FIGS. 2*a* and 2*b* are front and cross sectional side views respectively of the second embodiment of present invention. Inside the shell housing 41 is mounted the horizontal drum 29 with foam pieces or sponges 30 attached to it. Rear wheels 31 are fixed to an axle 32 which is supported on bushings fixed to the shell housing. A belt 33 connects the rear wheel to the drum, so that when the machine is pushed on the floor, the rear wheels roll on the floor turning the drum slower than the wheels which causes rubbing action between floor and foam pieces attached to the drum thus ensuring mopping of the floor. The movement of the drum brings the wet foam pieces from mopping positions into contact with rollers 34 at the back where dirty water is squeezed out on to a tray 35. Foam pieces placed around the outer surface of the drum 29 are not continuous but preferably segmented so that while one segment is being squeezed between the drum 29 and the roller 34, the following segment remains spaced far enough backward so that it does not receive any squeezed-out dirty water from the foam segment being squeezed. Two front wheels 36 assure correct compression of foam pieces on floor. Also shown an unique hollow handle 37 which can act as a reservoir for fresh water. A stop-valve 38 can be pulled by a link rod 39 releasing water for mopping operation through a discharge tube 40.

According to a third embodiment of the invention, the mopping means comprises a rotating disk which has a rigid core portion and a flexible outer ring portion. The said mop members being removably mounted on the said flexible outer ring portion. The rotating disk is angularly disposed in the housing such that the part of the disk towards the front of the machine is close to the floor while the other end towards the back is raised up. A pair of inclined rollers provided close to the raised end of the disk such that the mop members on the outer ring of the disk are pressed between the said pair of rollers. Due to the flexibility of the outer ring of the disk the mop members are pressed on the surface to be cleaned.

Figure 3A:
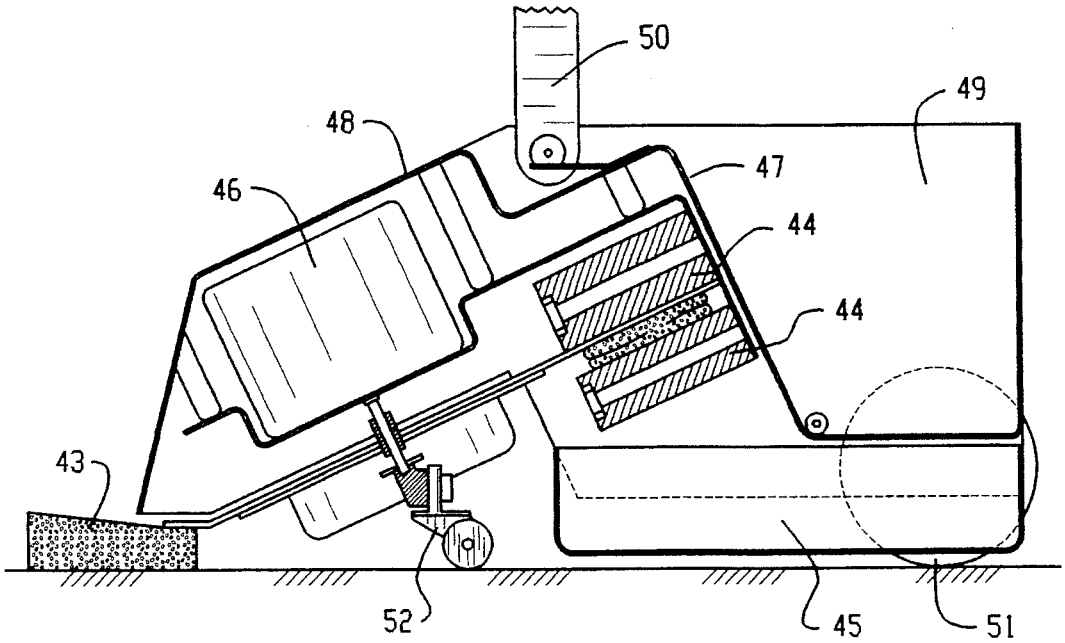
FIGS. 3*a* and 3*b* are views of a third embodiment of the present invention.
Figure 3B:
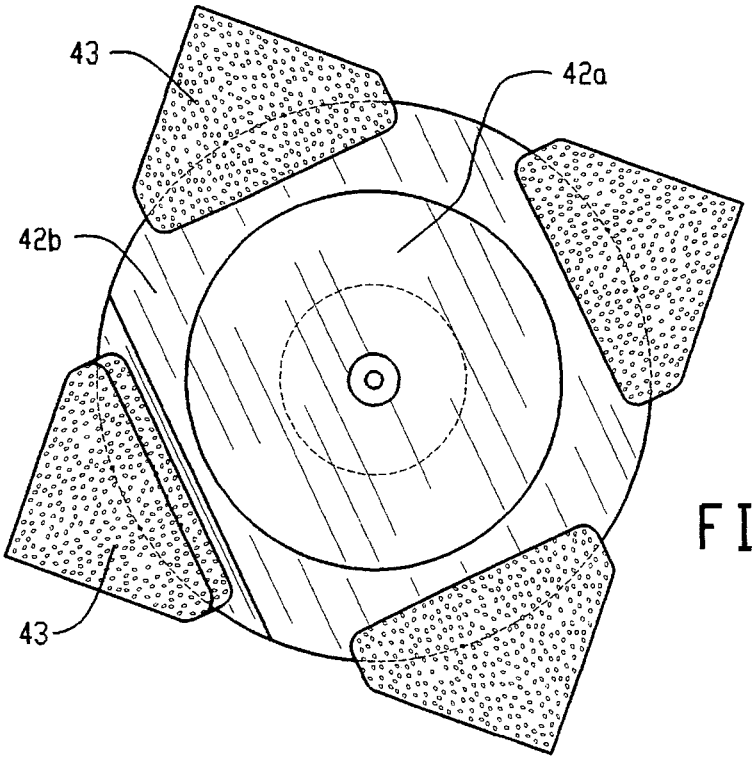

FIGS. 3*a* and 3*b* show the third embodiment of present invention. In this version a rotating disc with mop pieces is held at an angle with respect to the floor, so that the part of disc towards the front of the machine is close to the floor while the other end towards the back is raised up.

FIG. 3*b* shows the rotating disc with a solid plate 42*a* at the center and a flexible outer ring 42*b* on which foam pieces 43 are attached. As the foam pieces come closer to the floor, they are pressed on it by the bending action of the flexible part of the disc which provides mopping pressure. As foam pieces 43 move towards rear of the machines, they are forced between two rollers 44 and dirty water is squeezed out into a removable tray 45. The rotating disc is fixed directly on to motor 46 which together with the rollers are mounted on a sub-chassis 47. The sub-chassis 47 is fitted inside a shell housing 48 which includes fresh water tank 49 with suitable discharges spout (not shown) and a handle assembly 50. Two rear wheels 51 are mounted on the same shelling housing. Front part of the machine is supported on a swivelling wheel 52.

In each of the aforesaid embodiments the housing is mounted on wheels and the cleaning fluid is stored in a storage tank. The fluid is directed to the mop members upon being actuated by an actuation means. Further the movement of the machine is controlled by a handle. The handle is preferably a pipe and the storage tank is housed inside the pipe for compactness.

A preferred cleaning liquid is water in which one or more of perfume, disinfectants, liquid soap and other cleaning medium are optionally added. The machine is electrically operated and comprises a motor for the rotation of the mopping means. The machine can also be operated by power derived from wheels mounted on the housing, when such wheels rotate as the housing is manually moved on the floor. The size of the machine will depend on its application and the smaller models would be portable, handy and light-weight.

The basic advantages of the mopping machine according to the invention are: By moving the device which is provided with suitable wheels, the mopping, comprising of rubbing wet mops on the floor and squeezing dirty water on to a removable separate receptacle, is done automatically without any further manual operation. The fresh water tank discharges clean water on to the mop after dirty water is squeezed out from it. The device is very efficient in water usage and it is found that only one liter of clean water is needed to clean and mop an area of one thousand square feet. By shaping the mop pieces suitably, floor corners can be cleaned thoroughly which conventional mops rarely do. The mop pieces may be replaced.

The invention has been described with respect to typical embodiment to describe the invention fully but not to limit only to such embodiments. Other and further embodiments or modifications that may be designed hereinafter and falling with the scope of the appended claims would also form part of the present invention.

I claim:

1. A floor mopping machine for automatic mopping of a surface to be cleaned comprising:

a movable housing;

a rotatable mopping member connected to said housing, said rotatable mopping member including a plurality of spongy mop pieces capable of soaking liquid and releasing the same when pressed, wherein during rotation of the mopping member, said spongy mop pieces are pressed on the surfaces to be cleaned, wherein said mopping member further comprises:

a plurality of arms having ends rotatable about an axis, wherein said mop pieces are placeably held to the arms at their ends away from the axis of rotation;

a guiding member provided in said housing for guiding the arms carrying the mop pieces back and forth between mopping and pressing positions; said mopping machine also comprising:

a rotating member connected to said mopping member for rotating the mopping member;

a storing receptacle provided in said housing including an aqueous cleaning medium and dispensing the same to said spongy mop pieces;

a pressing member connected to said housing for pressing the spongy mop pieces to release the liquid held by the said pieces; and a collector connected to said housing for collecting the liquid released by the spongy mop pieces.

2. The floor mopping machine of claim 1 wherein the housing is mounted on wheels so as to be movable.

3. The floor mopping machine of claim 1 wherein the guiding means comprises cam tracks and rollers provided with the arms, said tracks being configured such that the ends of the arms carrying the mop members press against the floor at the mopping position and progressively lifted to a higher plane to the pressing position for release of the liquid collected at the mopping position.

4. The floor mopping machine of claim 1 wherein the cleaning medium is stored in a storage tank, including a dispenser to supply said cleaning liquid to the mop members.

5. The floor mopping machine of claim 1 comprising a handle for controlling the movement of the machine.

6. The floor mopping machine of claim 1 wherein the cleaning medium is water and further includes an additive selected from the group consisting of: perfume, disinfectants, liquid soap and cleaning fluid.

7. A floor mopping machine of claim 1 wherein the rotating member for rotating the mopping member comprises an electrically operated motor.

* * * * *